US007011570B1

(12) United States Patent
Mac Leod

(10) Patent No.: US 7,011,570 B1
(45) Date of Patent: Mar. 14, 2006

(54) SET OF PROFILED SANDING PADS

(75) Inventor: Earl J. Mac Leod, Queen Charlotte (CA)

(73) Assignee: Earl John Mac Leod

( * ) Notice: Subject to any disclaimer, the term of this patent is extended or adjusted under 35 U.S.C. 154(b) by 0 days.

(21) Appl. No.: 09/910,265

(22) Filed: Jul. 20, 2001

(51) Int. Cl.
*B24B 23/00* (2006.01)

(52) U.S. Cl. ..... 451/356; 451/344; 451/539

(58) Field of Classification Search ..... 451/344, 451/356, 313, 490, 510, 523, 524, 525, 539, 451/354
See application file for complete search history.

(56) References Cited

U.S. PATENT DOCUMENTS 3,192,678 A * 7/1965 Buratti
3,279,130 A 10/1966 Nelson
3,914,906 A * 10/1975 Barnes
4,128,970 A * 12/1978 Sawrenko
4,774,789 A 10/1988 Amalfi
5,016,402 A 5/1991 Reiter
5,345,724 A 9/1994 Ng
D355,829 S 2/1995 Kotlarz
5,743,791 A 4/1998 Bosten et al.
6,120,365 A * 9/2000 Johnson ..... 451/495
6,325,708 B1 * 12/2001 Miles ..... 451/354
6,406,365 B1 * 6/2002 Ueno ..... 451/523

* cited by examiner

*Primary Examiner*—Eileen P. Morgan
(74) *Attorney, Agent, or Firm*—Earl J Mac Leod

(57) ABSTRACT

A set of profiled sanding pads for doing bodywork on vehicles and the like where specific areas require sanding attachments that conform to the unique contours encountered. The set of profiled sanding pads includes a plurality of elongate members, each having a distinctive configuration with a padded sanding side, and a side mountable to an existing sander.

1 Claim, 7 Drawing Sheets

SET OF PROFILED SANDING PADS

BACKGROUND OF THE INVENTION

1. Field of the Invention

The present invention relates to sanding pads and more particularly pertains to a new set of profiled sanding pads for doing bodywork on vehicles and the like where specific areas require sanding attachments that conform to the unique contours encountered.

2. Description of the Prior Art

The use of sanding pads is known in the prior art. More specifically, sanding pads heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,774,789; 5,345,724; 3,279,130; 5,016,402; 5,743,791; and Des. 355,829.

While these devices fulfill their respective, particular objectives and requirements, the aforementioned patents do not disclose a new set of profiled sanding pads. The inventive device includes a plurality of elongate members, each having a distinctive configuration with a padded sanding side, and a side mountable to an existing sander.

In these respects, the set of profiled sanding pads according to the present invention substantially departs from the conventional concepts and designs of the prior art, and in so doing provides an apparatus primarily developed for the purpose of doing bodywork on vehicles and the like where specific areas require sanding attachments that conform to the unique contours encountered.

SUMMARY OF THE INVENTION

In view of the foregoing disadvantages inherent in the known types of sanding pads now present in the prior art, the present invention provides a new set of profiled sanding pads construction wherein the same can be utilized for doing bodywork on vehicles and the like where specific areas require sanding attachments that conform to the unique contours encountered.

The general purpose of the present invention, which will be described subsequently in greater detail, is to provide a new set of profiled sanding pads apparatus and method which has many of the advantages of the sanding pads mentioned heretofore and many novel features that result in a new set of profiled sanding pads which is not anticipated, rendered obvious, suggested, or even implied by any of the prior art sanding pads, either alone or in any combination thereof.

To attain this, the present invention generally comprises a plurality of elongate members, each having a distinctive configuration with a padded sanding side, and a side mountable to an existing sander.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new set of profiled sanding pads apparatus and method which has many of the advantages of the sanding pads mentioned heretofore and many novel features that result in a new set of profiled sanding pads which is not anticipated, rendered obvious, suggested, or even implied by any of the prior art sanding pads, either alone or in any combination thereof.

It is another object of the present invention to provide a new set of profiled sanding pads which may be easily and efficiently manufactured and marketed.

It is a further object of the present invention to provide a new set of profiled sanding pads which is of a durable and reliable construction.

An even further object of the present invention is to provide a new set of profiled sanding pads which is susceptible of a low cost of manufacture with regard to both materials and labor, and which accordingly is then susceptible of low prices of sale to the consuming public, thereby making such set of profiled sanding pads economically available to the buying public.

Still yet another object of the present invention is to provide a new set of profiled sanding pads which provides in the apparatuses and methods of the prior art some of the advantages thereof, while simultaneously overcoming some of the disadvantages normally associated therewith.

Still another object of the present invention is to provide a new set of profiled sanding pads for doing bodywork on vehicles and the like where specific areas require sanding attachments that conform to the unique contours encountered.

Yet another object of the present invention is to provide a new set of profiled sanding pads which includes a plurality of elongate members, each having a distinctive configuration with a padded sanding side, and a side mountable to an existing sander.

Still yet another object of the present invention is to provide a new set of profiled sanding pads that are designed for specific areas on various makes and models of vehicles for the sanding process while doing bodywork, thereby increasing the efficiency of the technician.

Even still another object of the present invention is to provide a new set of profiled sanding pads that are quickly and easily mountable to existing sanders.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
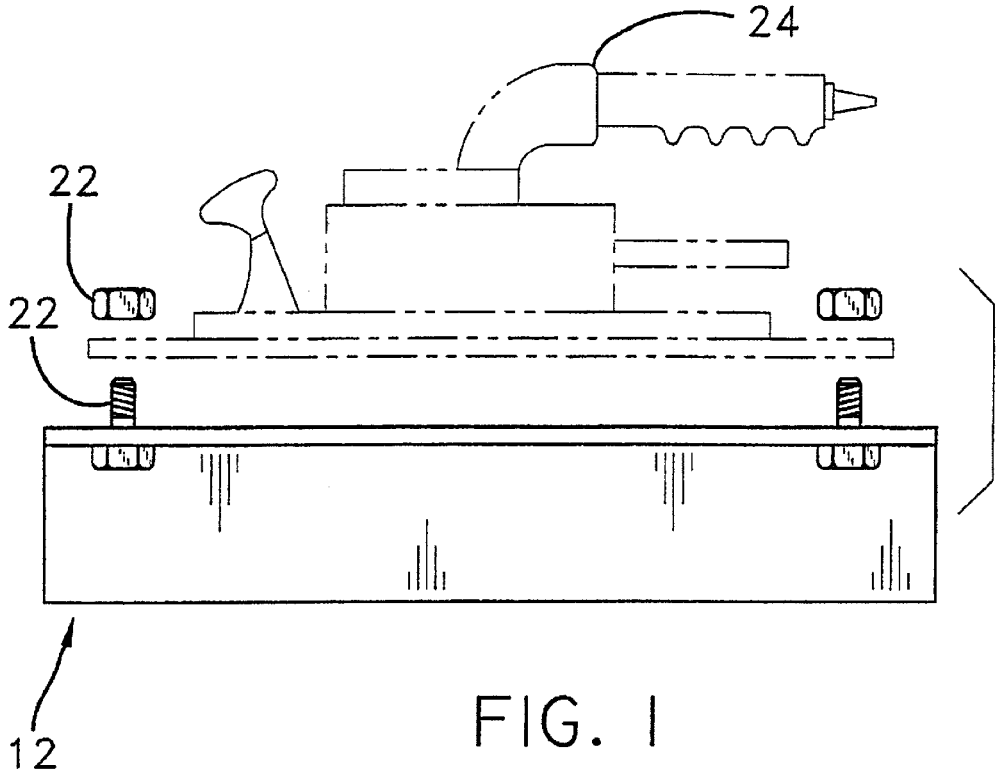
FIG. 1 is a schematic side view depicting the existing sander and one of the sanding pads of a new set of profiled sanding pads according to the present invention.

With reference now to the drawings, and in particular to FIGS. 1 through 7 thereof, a new set of profiled sanding pads embodying the principles and concepts of the present invention and generally designated by the reference numeral 10 will be described.

As best illustrated in FIGS. 1 through 7, the set of profiled sanding pads 10 generally comprises a plurality of elongate members 12. Each of the elongate members 12 includes a distinctive configuration.

The elongate members 12 include a main member 14. The main member 14 includes a sanding side 16 and a mounting side 18.

The sanding side 16 is for contacting an object to be sanded. The sanding side 16 of the elongate members 12 includes an elastic material 20 that is fixedly coupled to the sanding side 16. The elastic material 20 is for selectively coupling sandpaper to such that the elastic material 20 provides a buffer between the sanding side 16 of the elongate members 12 and the object being sanded.

The mounting side 18 of the elongate members 12 includes a mounting means 22 for mounting the elongate members 12 to an existing sander 24. The mounting side 18 is for coupling to the existing sander 24 such that a plurality of objects that have unique forms are thereby sandable.

The main member 14 of a first of the elongate members 25 includes a v-shaped cross section. The cross section is perpendicular to a longitudinal axis of the first of the elongate members 25.

The first of the elongate members 25 includes a plurality of mounting plates 26. The mounting plates 26 are fixedly coupled to the mounting side 18 of the first of the elongate members 25 such that the cross section of the first of the elongate members 25 and the mounting plates 26 form an isosceles triangle.

The mounting plates 26 include the mounting means 22 for mounting to the existing sander 24.

The sanding side 16 of the first of the elongate members 25 is a side opposite of the mounting side 18.

The main member 14 of a second of the elongate members 28 includes an arcuate cross section. The cross section is perpendicular to a longitudinal axis of the second of the elongate members 28.

The second of the elongate members 28 includes a plurality of mounting plates 26. The mounting plates 26 are fixedly coupled to the mounting side 18 of the second of the elongate members 28 such that the cross section of the second of the elongate members 28 and the mounting plates 26 is arcuate.

The mounting plates 26 include the mounting means 22 for mounting to the existing sander 24.

The sanding side 16 of the second of the elongate members 12 is a side opposite of the mounting side 18.

The main member 14 of a third of the elongate members 30 includes a medial section 32, a first side section 34, and a second side section 36. The first and second side sections 34,36 are on opposing sides 37 of the medial section 32, and angle away from the medial section 32 in opposite directions.

The medial section 32 of the main member 14 includes the mounting means 22 for mounting to the existing sander 24.

The sanding side 16 of the third of the elongate members 12 is a side opposite a side the mounting members 40 protrude from for coupling to the existing sander 24.

The main member 14 of a fourth of the elongate members 44 includes a medial section 32, a first side section 34, and a second side section 36. The first and second side sections 34,36 are on opposing sides 37 of the medial section 32, and angle away from the medial section 32 in a similar direction such that the obtuse angles 46 between the medial section 32 and the side sections are substantially equal.

The side sections of the main member 14 include a width that is substantially equal. The medial section 32 of the main member 14 includes a width that is substantially greater than the width of the side sections of the main member 14.

The fourth of the elongate members 44 includes a plurality of mounting plates 26. The mounting plates 26 are fixedly coupled to the mounting side 18 of the fourth of the elongate members 44 such that the cross section of the fourth of the elongate members 44 and 1the mounting plates 26 form a trapezoid.

The mounting plates 26 include the mounting means 22 for mounting to the existing sander 24.

The sanding side 16 of the fourth member is a side opposite of the mounting side 18.

The main member 14 of a fifth of the elongate members 48 includes a medial section 32, a first side section 34, and a second side section 36. The first and second side sections 34, 36 are on opposing sides 37 of the medial section 32. The side sections angle away from the medial section 32 in a similar direction such that the obtuse angles 46 between the medial section 32 and the side sections are substantially equal.

The widths of the side sections and the medial section 32 of the main member 14 are substantially equal.

The fifth of the elongate members 48 include a plurality of mounting plates 26. The mounting plates 26 are fixedly coupled to the mounting side 18 of the fifth of the elongate members 48 such that the cross section of the fifth of the elongate members 48 and the mounting plates 26 form a trapezoid.

The mounting plates 26 include the mounting means 22 for mounting to the existing sander 24.

The sanding side 16 of the fifth member is a side opposite of the mounting side 18.

The main member 14 of a sixth of the elongate members 50 includes a unshaped cross section. The cross section is perpendicular to a longitudinal axis of the sixth of the elongate members 50.

The main member 14 includes a rear section 52, a top section 54, and a front section 56. The width of the rear, top, and front sections 52, 54, 56 are approximately the same.

The rear section 52 includes the mounting means 22. The mounting means 22 protrudes outwardly from a unshaped channel 59 for selectively coupling to the existing sander 24.

The sanding surface of the main member 14 is located on an inside surface 60 of the unshaped channel 59 such that the inside surface 60 faces a rear surface 62 of the front section 56. The rear surface 62 is opposite the mounting means 22.

In use, each of the sanding pads is designed for use on a specific vehicle, typically during the body work phase when a body filler has been applied to the vehicle and subsequently needs to be sanded.

Figure 2A:
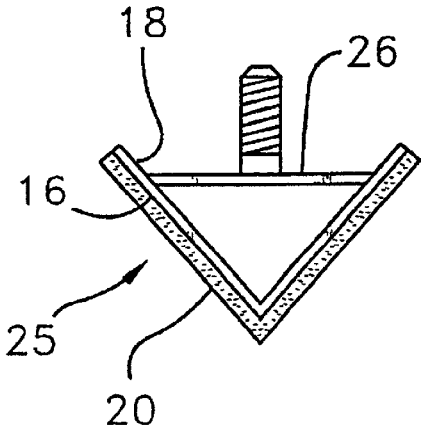
FIG. 2*a* is a schematic end view of the first one of the set of sanding pads.
Figure 2B:
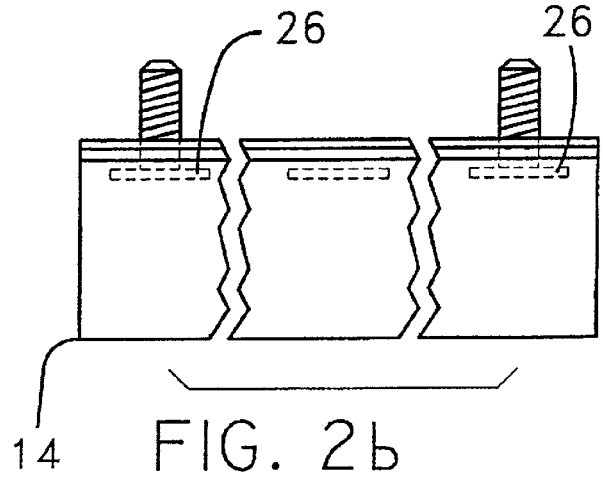
FIG. 2*b* is a schematic side view of the first one of the set of sanding pads.
Figure 2C:
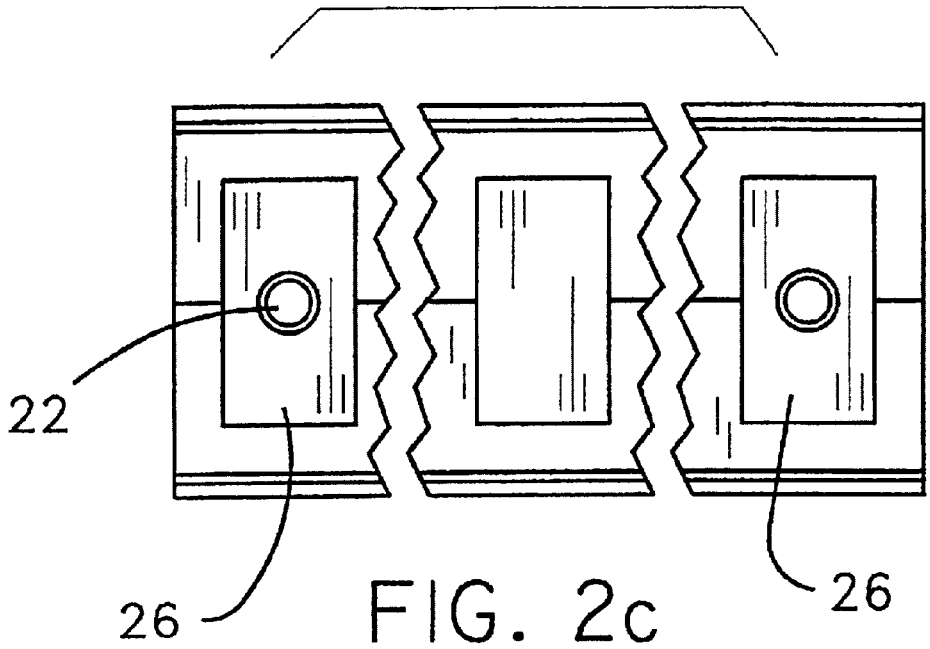
FIG. 2*c* is a schematic top view of the first one of the set of sanding pads.

The first sanding pad depicted in FIG. 2 is for use on a Chevrolet Blazer, models S-10, and S-15.

Figure 3A:
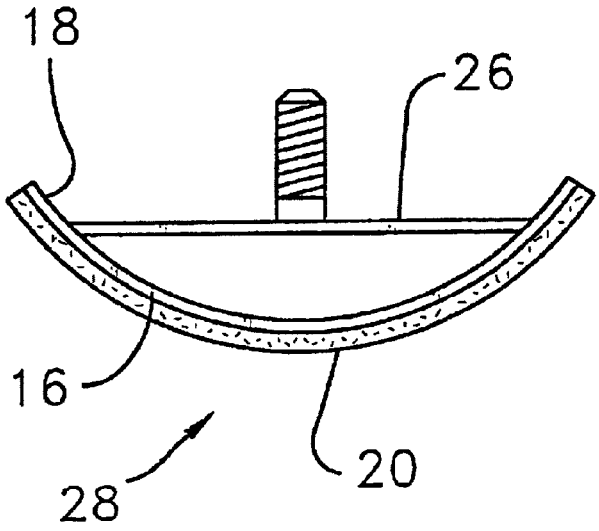
FIG. 3*a* is a schematic end view of the first one of the set of sanding pads.
Figure 3B:
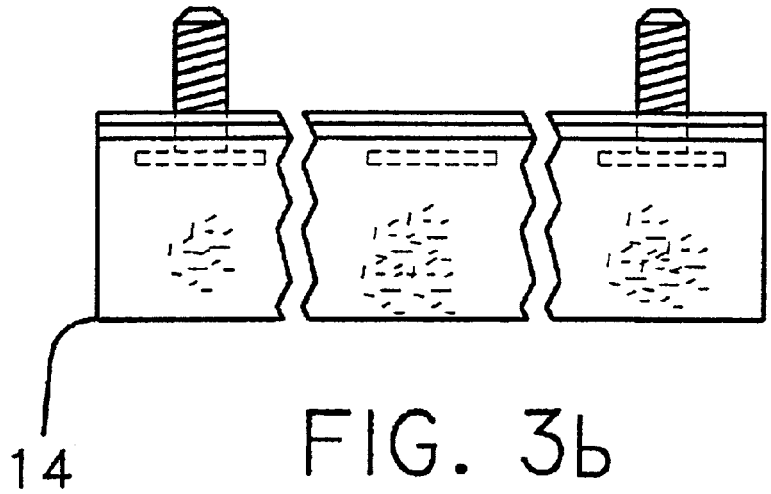
FIG. 3*b* is a schematic side view of the first one of the set of sanding pads.
Figure 3C:
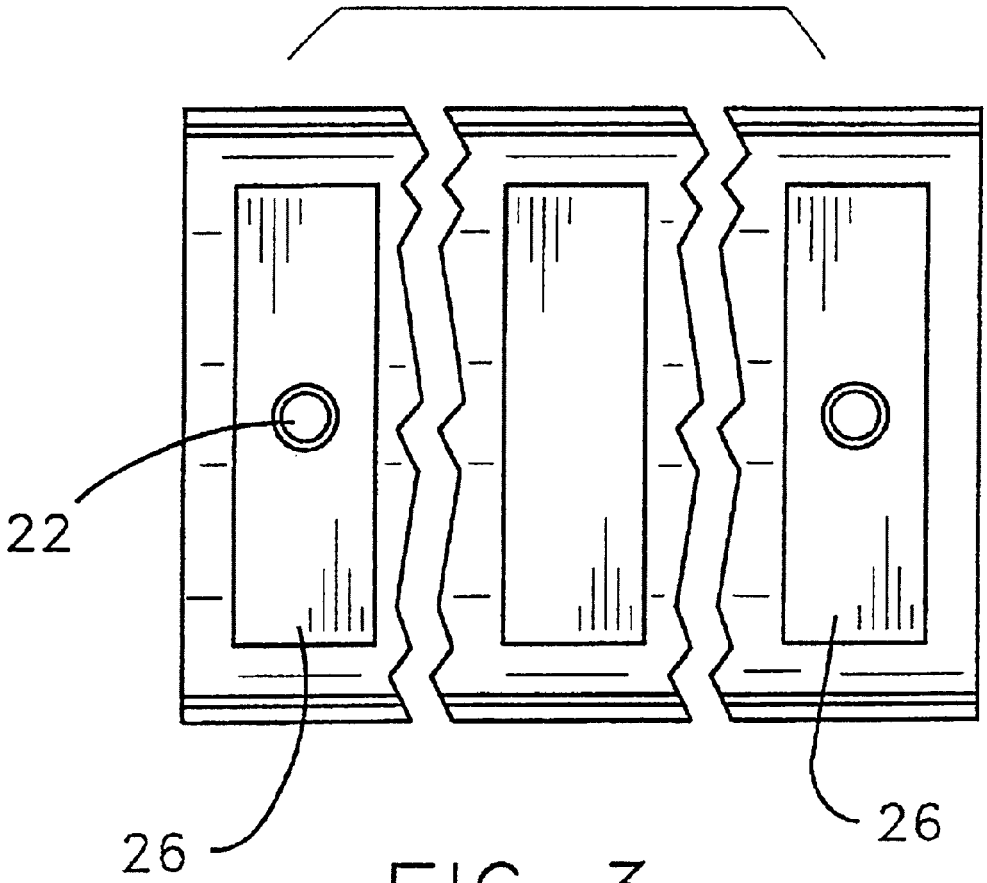
FIG. 3*c* is a schematic top view of the first one of the set of sanding pads.

The second sanding pad depicted in FIG. 3 is for use on older Ford pickups.

Figure 4A:
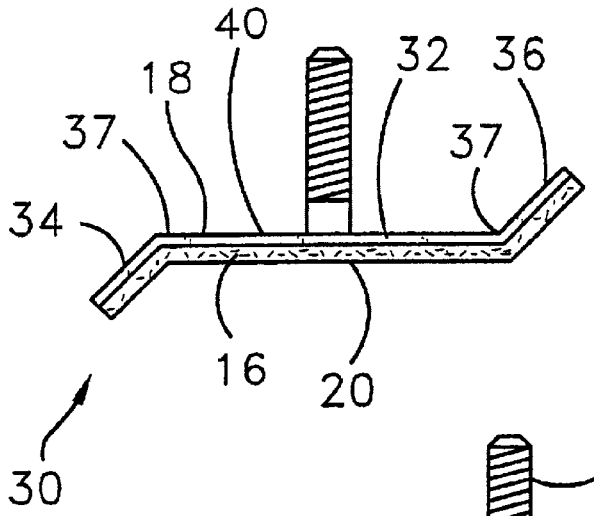
FIG. 4*a* is a schematic end view of the first one of the set of sanding pads.
Figure 4B:
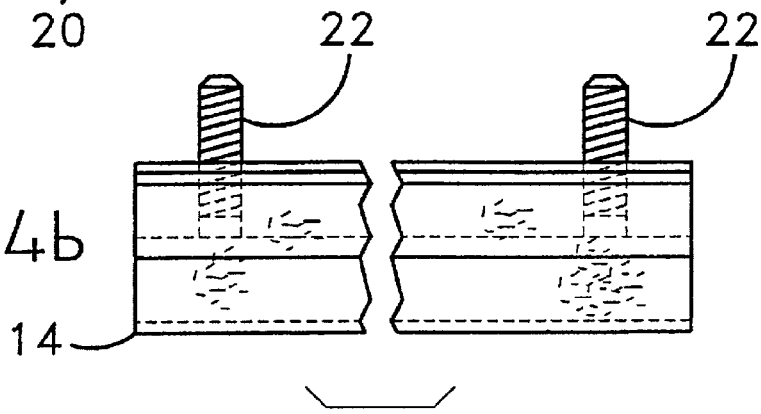
FIG. 4*b* is a schematic side view of the first one of the set of sanding pads.
Figure 4C:
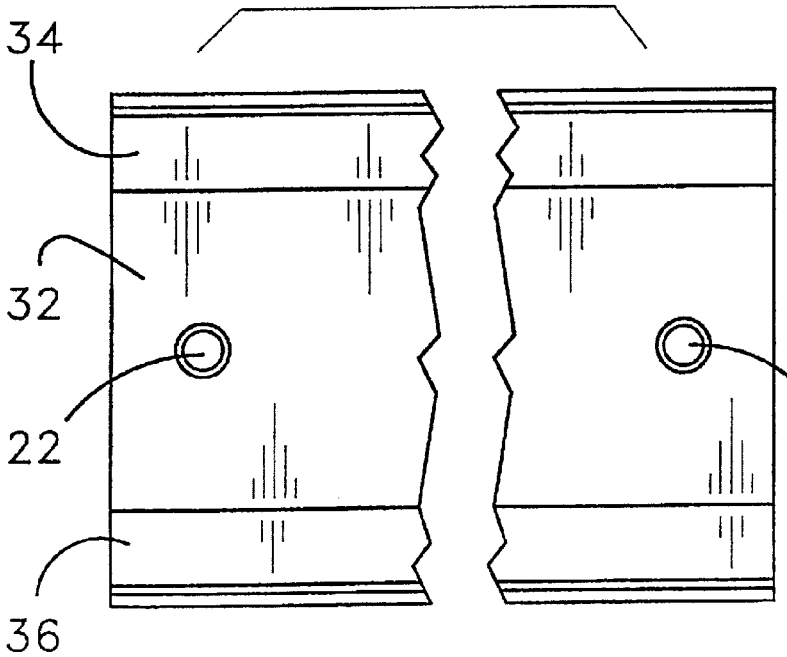
FIG. 4*c* is a schematic top view of the first one of the set of sanding pads.

The third sanding pad depicted in FIG. 4 is for use on 1980 and older Ford pickups for crown lines on the top part of the body lines.

Figure 5A:
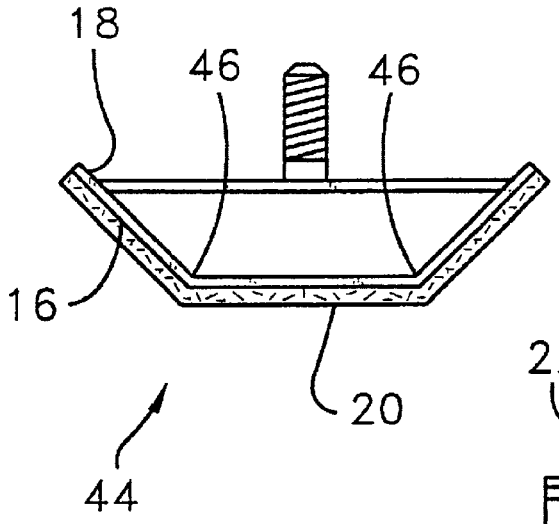
FIG. 5*a* is a schematic end view of the first one of the set of sanding pads.
Figure 5B:
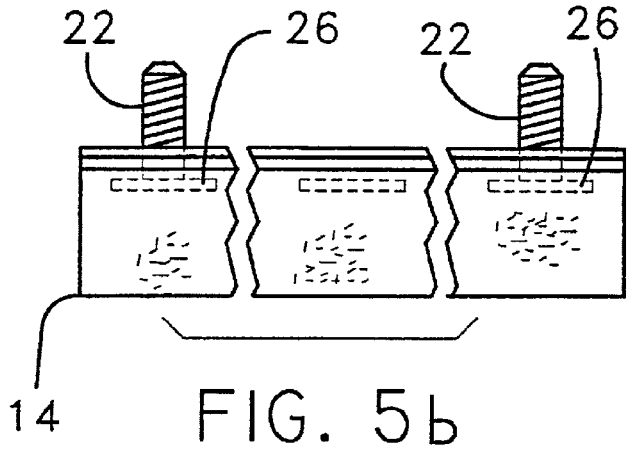
FIG. 5*b* is a schematic side view of the first one of the set of sanding pads.
Figure 5C:
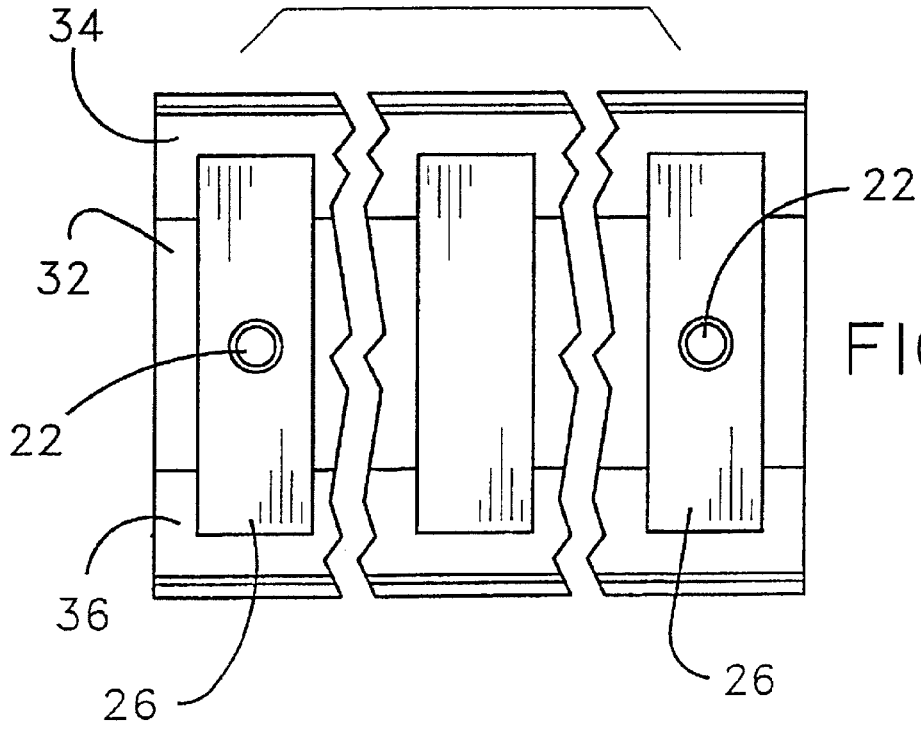
FIG. 5*c* is a schematic top view of the first one of the set of sanding pads.

The fourth sanding pad depicted in FIG. 5 is for use on 1987 GMC doors and quarter panels.

Figure 6A:
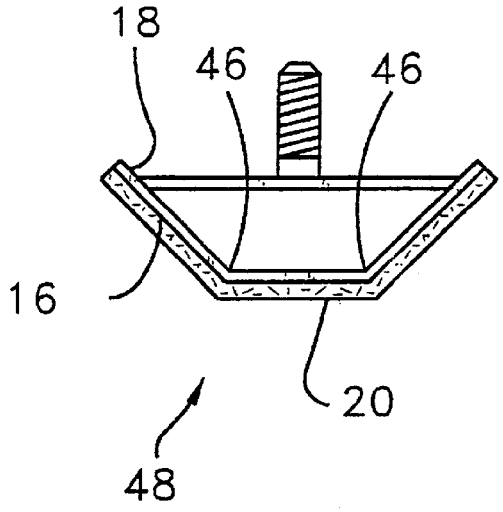
FIG. 6*a* is a schematic end view of the first one of the set of sanding pads.
Figure 6B:
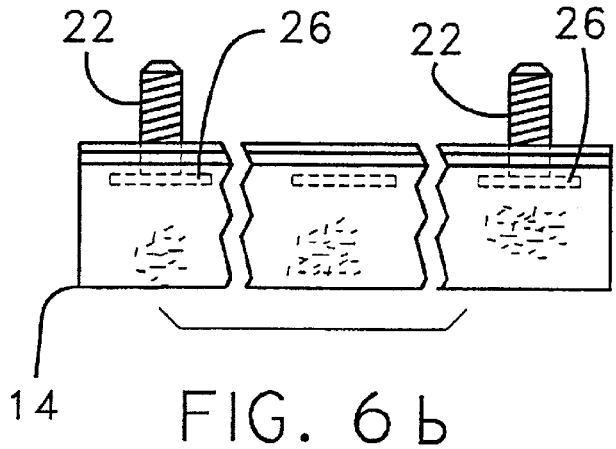
FIG. 6*b* is a schematic side view of the first one of the set of sanding pads.
Figure 6C:
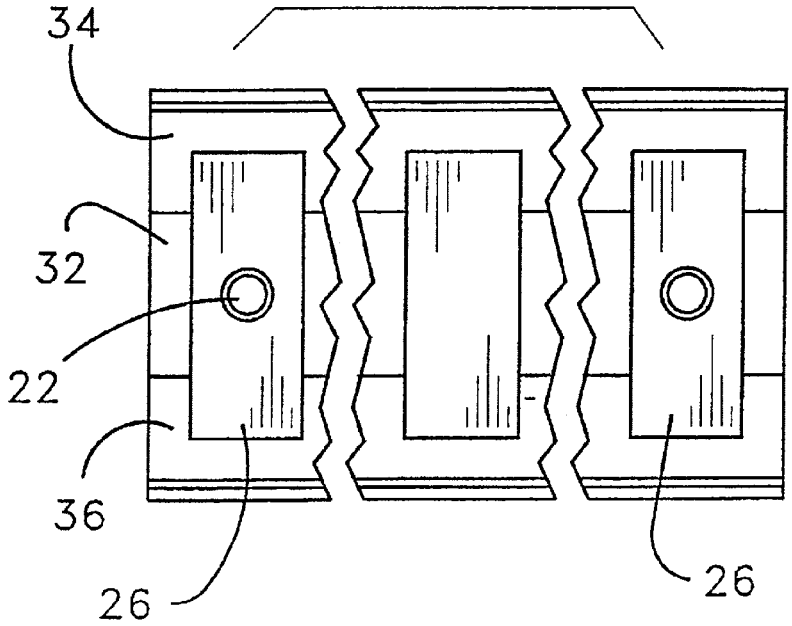
FIG. 6*c* is a schematic top view of the first one of the set of sanding pads.

The fifth sanding pad depicted in FIG. 6 is for use on Ford Tempo and Taurus doors and quarter panels.

Figure 7A:
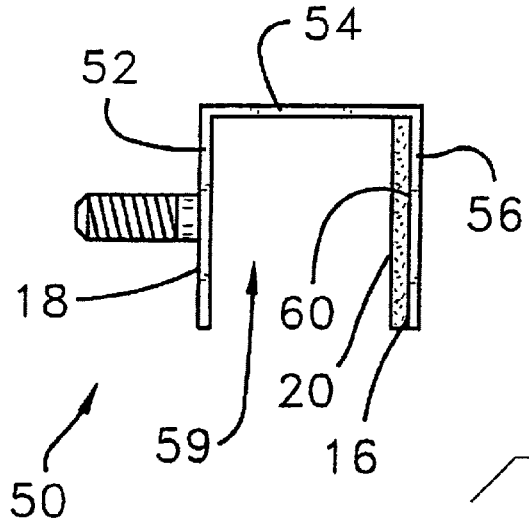
FIG. 7*a* is a schematic end view of the first one of the set of sanding pads.
Figure 7B:
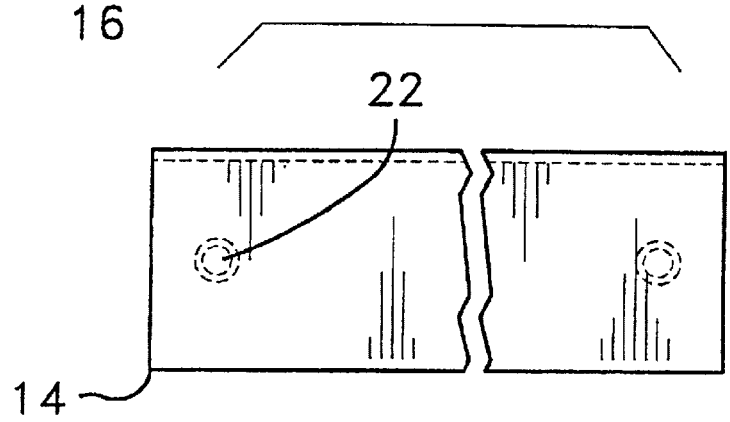
FIG. 7*b* is a schematic top view of the first one of the set of sanding pads.
Figure 7C:
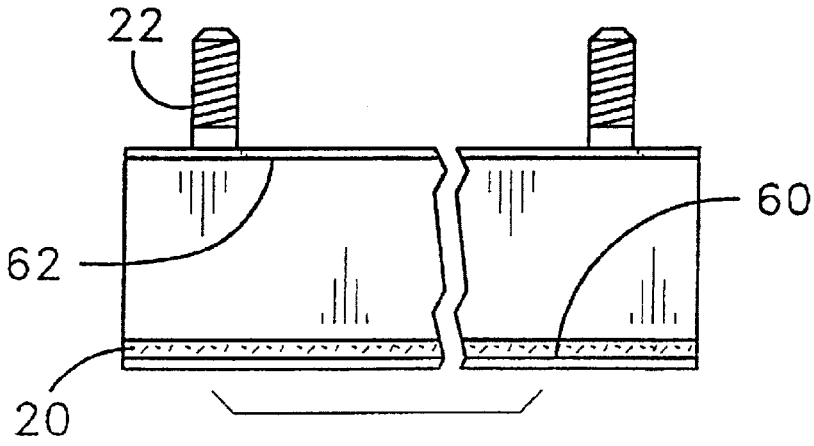
FIG. 7*c* is a schematic side view of the first one of the set of sanding pads.

The sixth sanding pad depicted in FIG. 7 is for use on that portion of a pickup cab at the top of the box which faces the rear of the pickup cab.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A set of profiled sanding pads for use in special automotive and other bodywork applications, the set of profiled sanding pads comprising:

a plurality of elongate members, each of said elongate members having a distinctive configuration;

said elongate members including a main member, said main member having a sanding side and a mounting side;

said sanding side being for contacting an object to be sanded, said sanding side of each of said elongate members including an elastic material, said elastic material being fixedly coupled to said sanding side of each of said elongate members such that said elastic material is positioned between said main member of each of said elongate members and the object being sanded, said elastic material being for selectively coupling sandpaper to such that said elastic material provides a buffer between said sanding side of said main member of each of said elongate members and the object being sanded;

said mounting side of each of said elongate members including mounting means for mounting said elongate member to an existing sander, said mounting side being for coupling to the existing sander such that a plurality of objects having unique forms are thereby sandable;

said main member of a first of said elongate members having a V-shaped cross section, said cross section being perpendicular to a longitudinal axis of said first of said elongate members;

said first of said elongate members including a plurality of mounting plates, said mounting plates being fixedly coupled to said mounting side of said first of said elongate members such that said cross section of said first of said elongate members and said mounting plates form an isosceles triangle;

said mounting plates of said first of said elongate members including said mounting means for mounting to the existing sander;

said sanding side of said first of said elongate members being a side opposite of said mounting side;

said main member of a second of said elongate members having an arcuate cross section, said cross section being perpendicular to a longitudinal axis of said second of said elongate members;

said second of said elongate members including a plurality of mounting plates, said mounting plates being fixedly coupled to said mounting side of said second of said elongate members such that said cross section of said second of said elongate members and said mounting plates being arcuate;

said mounting plates of said second of said elongate members including said mounting means for mounting to the existing sander;

said sanding side of said second of said elongate members being a side opposite of said mounting side;

said main member of a third of said elongate members including a medial section, a first side section, and a second side section, said first and second side sections being on opposing sides of said medial section, said first and second side sections angling away from said medial section in opposite directions;

said medial section of said main member of said third of said elongate members including a top surface, said top surface including said mounting means for mounting to the existing sander; and said sanding side of said third of said elongate members being a side opposite of said top surface;

said main member of a fourth of said elongate members including a medial section, a first side section, and a second side section, said first and second side sections being on opposing sides of said medial section, said side sections angling away from said medial section in a similar direction such that the obtuse angles between said medial section and said side sections are-substantially equal;

said side sections of said main member of said fourth of said elongate members having a width being substantially equal, said medial section of said main member having a width being substantially greater than said side sections of said main member;

said fourth of said elongate members including a plurality of mounting plates, said mounting plates being fixedly coupled to said mounting side of said fourth of said elongate members such that said cross section of said fourth of said elongate members and said mounting plates form a trapezoid;

said mounting plates of said fourth of said elongate members including said mounting means for mounting to the existing sander;

said sanding side of said fourth of said elongate members being a side opposite of said mounting side;

said main member of a fifth of said elongate members including a medial section, a first side section, and a second side section, said first and second side sections being on opposing sides of said medial section, said side sections angling away from said medial section in a similar direction such that the obtuse angles between said medial section and said side sections are substantially equal;

said side sections and said medial section of said main member of said fifth of said elongate members having a width being substantially equal;

said fifth of said elongate members including a plurality of mounting plates, said mounting plates being fixedly coupled to said mounting side of said fifth of said elongate members such that said cross section of said fifth of said elongate members and said mounting plates form a trapezoid;

said mounting plates of said fifth of said elongate members including said mounting means for mounting to the existing sander;

said sanding side of said fifth of said elongate members being a side opposite of said mounting side;

said main member of a sixth of said elongate members having a U-shaped cross section, said cross section being perpendicular to a longitudinal axis of said sixth of said elongate members;

said main member of said sixth of said elongate members having a rear section, a top section, and a front section, said rear, top and front sections having approximately the same width;

said rear section of said sixth of said elongate members including said mounting means, said mounting means protruding outwardly from a u-shaped channel defined by said rear, top and front sections for being selectively couplable to the existing sander; and said sanding surface of said main member of said sixth of said elongate members being located on an inside surface of said U-shaped channel.

* * * * *